US008487859B2

(12) United States Patent
Kim et al.

(10) Patent No.: US 8,487,859 B2
(45) Date of Patent: Jul. 16, 2013

(54) DATA DRIVING APPARATUS AND METHOD FOR LIQUID CRYSTAL DISPLAY DEVICE

(75) Inventors: Seok Su Kim, Daegu-kwangyokshi (KR); Chang Gone Kim, Daegu-kwangyokshi (KR); Gi Suck Kwon, Kyongsangbuk-do (KR); Seok Woo Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 477 days.

(21) Appl. No.: 10/664,912

(22) Filed: Sep. 22, 2003

(65) Prior Publication Data

US 2004/0125067 A1 Jul. 1, 2004

(30) Foreign Application Priority Data

Dec. 30, 2002 (KR) ..... 10-2002-0086998
Jun. 30, 2003 (KR) ..... 10-2003-0043606

(51) Int. Cl.
*G09G 3/36* (2006.01)

(52) U.S. Cl.
USPC ..... 345/100

(58) Field of Classification Search
USPC ..... 345/204, 30, 87–104, 80
See application file for complete search history.

(56) References Cited

U.S. PATENT DOCUMENTS

| | | | | |
|---|---|---|---|---|
| 5,170,158 | A * | 12/1992 | Shinya | 345/98 |
| 5,361,081 | A * | 11/1994 | Barnaby | 715/857 |
| 5,892,493 | A * | 4/1999 | Enami et al. | 345/94 |
| 6,097,362 | A * | 8/2000 | Kim | 345/87 |
| 6,268,841 | B1 * | 7/2001 | Cairns et al. | 345/98 |
| 6,333,729 | B1 * | 12/2001 | Ha | 345/98 |
| 6,661,402 | B1 * | 12/2003 | Nitta et al. | 345/99 |
| 6,734,865 | B1 * | 5/2004 | Peterson et al. | 345/544 |
| 6,847,346 | B2 * | 1/2005 | Kumagai et al. | 345/98 |
| 6,989,810 | B2 * | 1/2006 | Morita | 345/98 |
| 2002/0030653 | A1 * | 3/2002 | Cairns et al. | 345/87 |

FOREIGN PATENT DOCUMENTS

| | | |
|---|---|---|
| JP | 11-259036 | 9/1999 |
| KR | 1020010040219 | 5/2001 |

* cited by examiner

*Primary Examiner* — Sumati Lefkowitz
*Assistant Examiner* — Robert E Carter, III
(74) *Attorney, Agent, or Firm* — McKenna, Long & Aldridge, LLP.

(57) ABSTRACT

The present invention discloses a data driving apparatus and method for a liquid crystal display device having a first multiplexer part performing a time-division on inputted digital pixel data, a digital-analog converter part converting the time-divided digital pixel data from the first multiplexer part to analog pixel signals, a demultiplexer part supplying the analog pixel signals from the digital-analog converter part to a plurality of output channels, and an output part sampling and holding first received analog pixel signals from the demultiplexer part and holding second received analog pixel signals and simultaneously outputting both the first and second received pixel signals to corresponding data lines.

15 Claims, 8 Drawing Sheets

DATA DRIVING APPARATUS AND METHOD FOR LIQUID CRYSTAL DISPLAY DEVICE

This application claims the benefit of the Korean Patent Applications No. P2002-086998 filed on Dec. 30, 2002, and No. P2003-043606 filed on Jun. 30, 2003, which are hereby incorporated by reference.

BACKGROUND OF THE INVENTION

1. Field of the Invention

The present invention relates to a liquid crystal display, and more particularly, to a data driving apparatus and method for a liquid crystal display device. Although the present invention is suitable for a wide scope of applications, it is particularly suitable for capable of reducing the number of data driving integrated circuits and preventing a distortion of pixel signals.

2. Discussion of the Related Art

In general, a liquid crystal display (LCD) device controls light transmittance of liquid crystal having a dielectric anisotropy using an electric field to display a picture. To this end, the LCD includes a liquid crystal display panel having liquid crystal cells arranged in a matrix form, and a driving circuit for driving the liquid crystal display panel.

More specifically, as shown in FIG. 1, the liquid crystal display panel includes a liquid crystal display panel 2 having a plurality of pixel matrices, a gate driver 4 for driving a plurality of gate lines G10 to GLn of the liquid crystal panel 2, a data driver 6 for driving a plurality of data lines DL1 to DLm of the liquid crystal panel 2, a timing controller 8 for controlling driving timing of the gate driver 4 and the data driver 6 and a reference gamma voltage part 10 for supplying a reference gamma voltage to the data driver 6.

The liquid crystal display panel 2 includes a pixel matrix composed of a plurality of sub-pixels defined at each intersection of the gate lines and the data lines. Each of the sub-pixels includes a liquid crystal cell Clc for controlling light transmittance in accordance with the pixel signal and a thin film transistor (TFT) for driving the liquid crystal cell Clc.

The TFT is turned-on when a scan signal DL to the liquid crystal cell Clc. Herein, the scan signal is a gate high voltage VGH from the gate line GL provided to the TFT to supply the pixel signal from the data line Further. Conversely, the TFT is turned off when a gate low voltage VGL is supplied thereto to maintain the pixel signal charged to the liquid crystal cell Clc.

The liquid crystal cell Clc can be equivalently represented as a capacitor, and includes a common electrode and a pixel electrode connected to the TFT where a liquid crystal material is inserted between the common electrode and the pixel electrode. The liquid crystal cell Clc further comprises a storage capacitor Cst for stably maintaining the pixel signal charged thereto until the next pixel signal is charged. Such a liquid crystal cell Clc varies with an arrangement of the liquid crystal having a dielectric anisotropy in accordance with the pixel signal charged through the TFT, and the liquid crystal cell Clc represents gray levels by controlling the light transmittance.

The gate driver 4 shifts a gate start pulse (hereinafter, referred to as. "GSP") from a timing controller 8 in accordance with a gate shift clock (hereinafter, referred to as "GSC) to supply a scan pulse of the gate high voltage VGH to the gate lines GL1 to GLm. The gate driver 4 supplies a gate low voltage VGL during a scan pulse of the gate high voltage VGH is not supplied to the gate lines GL1 to GLm. Further, the gate driver 4 controls a width of the scan pulse in accordance with a gate output enable (hereinafter, referred to as "GOE") from the timing controller 8. Such a gate driver 4 comprises a plurality of gate driving ICs for driving the gate lines GL0 to DLn in a time-divided manner.

The data driver 6 shifts a source start pulse (hereinafter, referred to as "SSP") from the timing controller 8 in accordance with a source shift clock (hereinafter, referred to as "SSC) to generate a sampling signal. Further, the data driver 6 latches input pixel data RGB by the SSC in accordance with the sampling signal, and then supplies the latched pixel data by a horizontal line unit in response to a source output enable (hereinafter referred to as "SOE") signal. Then, the data driver 6 converts the pixel data RGB supplied on horizontal line basis into analog pixel signals by using reference gamma voltages from the reference gamma voltage part 10 to supply the analog pixel signals to the data lines DL1 to DLm. At this time, the data driver 6 determines the polarity of the pixel signal, in response to the polarity controlling signal (hereinafter, referred to as "POL") from the timing controller 8 at the time of the conversion of the pixel data into the analog pixel signal. Further, the data driver 6 determines the timing that the analog pixel signals are supplied to the data lines DL1 to DLm in response to the SOE signal. The data driver 6 includes a plurality of the data driver ICs for driving the data lines DL1 to DLm in a time-divided manner.

The timing controller 8 generates GSP, GSC and GOE signals for controlling the gate driver 4, and generates SSP, SSC, SOE and POL signals for controlling the data driver 6. In this case, the timing controller 8 generates a data enable DE signal representing an effective data period, a horizontal synchronizing signal Hsync, a vertical synchronizing signal Vsync, and a variety of control signals such as the GSP, GSC, GOE, SSP, SSC, SOE, and POL by using a dot clock DCLK to determine the transmission timing of the pixel data RGB.

FIG. 2 is a block diagram showing a data driver IC included in the data driver 6 of FIG. 1.

A data driver IC 12 shown in the FIG. 2 includes a shift register 18 for sequentially generating a sampling signal, a latch part 20 for latching pixel data in response to the sampling signal, a digital-analog convert part 22 (hereinafter, referred to as "DAC") for converting the pixel data latched in the latch part 20 into the analog pixel signals, and an output buffering part 30 for buffering the analog pixel signals from the DAC part 22. Further, the data driver IC 12 includes a signal controller 14 for relaying the pixel data and control signals such as SSC, SSP, SOE, and POL signals supplied from the timing controller 8, and a gamma voltage part 16 for supplying a reference gamma voltages for the DAC part 22. The data driving IC 12 drives k-number of the data lines DL1 to DLk among m-number of the data lines DL1 to DLm as shown in FIG. 1.

The signal controller 14 relays the control signals such as SSP, SSC, SOE, and POL signals from the timing controller 8 and the pixel data to be supplied to corresponding components.

The gamma voltage part 16 subdivides a plurality of the reference gamma voltages inputted from the reference gamma voltage part 10 by gray levels to supply the reference gamma voltages to the DAC part 22. In this case, the gamma voltage part 16 generates a set of polarity gamma voltages and a set of negative gamma voltages with respect to the common voltage, which is the reference signal in driving liquid crystal cell Clc.

The shift register 18 sequentially shifts the SSP from the signal controller 14 in accordance with the SSC to generate the sampling signal.

The latch part 20, in response to the sampling signal from the shift register 18, samples and latches sequentially the pixel data from the signal controller 14. The latch part 20 is comprised of k-number of latches for latching k-number of pixel data. Each of the latches has a size corresponding to the bit number, e.g., 3-bit or 6-bit, of the pixel data. The latch part 20 simultaneously outputs the latched k-number of pixel data in response to the SOE signal from the signal controller 14. The latch part 20 includes a first latch part (not shown) for sampling and latching the pixel data inputted thereto and a second latch part (not shown) for simultaneously supplying the latched pixel data in the first latch part in response to the SOE signal.

The DAC part 22 converts the pixel data from the latch part 20 into the analog pixel signals having positive and negative polarities. To this end, the DAC part 22 includes the k-number of the DACs 21. Each of the DACs 21 includes a PDAC, a NDAC and a multiplexer (hereinafter referred to as "MUX") 28 for selectively outputting output signals of the PDAC and the NDAC.

The PDAC functions to convert the digital pixel data inputted from the latch part 20 into the positive analog pixel signal using the positive gamma voltage from the gamma voltage part 16.

The NDAC functions to convert the digital pixel data inputted from the latch part 20 into the negative analog pixel signal using the negative gamma voltage from the gamma voltage part 16.

In response to the POL signal from the signal controller 14, the MUX28 selects one of the positive pixel signal from the PDAC and the negative pixel signal from the NDAC.

The output buffering part 32 includes the k-number of output buffers 32. Each of the output buffers 32 includes a voltage follower connected in series to each of the data lines DL1 to DLk. Each output buffers 32 is to buffer the pixel signals from the DAC part 22 and output the pixel signals to the data lines DL1 to DLk.

As set forth above, the data driving IC 12 of the related art requires the k-number of the DACs 22 having the PDAC, the NDAC, and the MUX28 in order to drive the k-number of the data lines DL1 to DLk. In other words, the related art data driving IC 12 requires the k-number of the PDAC and the NDAC for driving the k-number of data lines DL1 to DLk. Therefore, the related art data driving IC 12 has the complicated constitution and its manufacturing cost is high as much as about 20-30% of the total manufacturing cost of the liquid crystal display module. Accordingly, there is a need to reduce the number of the driving Ics, thereby saving the manufacturing costs.

To do this, there has been a measure for reducing the number of the driving ICs by simply incorporating the data driving ICs. However, this measure makes the IC's size larger, so that the area of a tape carrier package (hereinafter referred to as a "TCP") or a chip on film (hereinafter referred to as a "COF") on which the driving is IC mounted becomes increased. Accordingly, the enlarged area of the TCP or the COF increases the manufacturing cost and provides a poor yield.

Furthermore, in the case of simplifying the constitution of the data driving IC to reduce the number of the driving ICs, it should meet the additional requirement to prevent a distortion of the pixel signal that affects the display quality.

SUMMARY OF THE INVENTION

Accordingly, the present invention is directed to a data driving method and apparatus for a liquid crystal display device that substantially obviates one or more of problems due to limitations and disadvantages of the related art.

Another object of the present invention is to provide a data driving method and apparatus for a liquid crystal display device having a reduced number of the data driving ICs by reducing the number of DACs by time-divided driving of the pixel data.

Another object of the present invention is to provide a data driving method and apparatus for a liquid crystal display device with a reduced the number of the data driving ICs capable of preventing a distortion of the output pixel signal.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a data driving apparatus for a liquid crystal display device comprises a first multiplexer part performing a time-division on inputted digital pixel data, a digital-analog converter part converting the time-divided digital pixel data from the first multiplexer part to analog pixel signals, a demultiplexer part supplying the analog pixel signals from the digital-analog converter part to a plurality of output channels, and an output part sampling and holding a first received analog pixel signals from the demultiplexer part and holding a second received analog pixel signals and simultaneously outputting both the first and second received pixel signals to corresponding data lines.

In another aspect of the present invention, a data driving apparatus for a liquid crystal display panel comprises a multiplexer part performing a time-division on inputted digital pixel data and providing the time-divided pixel data through output channels having a polarity, a digital-analog converter part converting the time-divided digital pixel data from the multiplexer into analog pixel signals with the polarity, a demultiplexer part providing the time-divided pixel signal from the digital-analog converter to different output channels with the polarity, and an output part sampling and holding the time-divided pixel signals from the demultiplexer through a path with the polarity and outputting the pixel signals to corresponding data lines for a next horizontal period.

In another aspect of the present invention, a data driving method for a liquid crystal display device includes performing a time-division on a digital pixel data, converting the time-divided digital pixel data into time-divided analog pixel signals, supplying the time-divided analog pixel signals to corresponding output channels, and sampling and holding first inputted pixel signals through a first part of the output channels and holding second inputted pixel signals from a second part of the output channels, and simultaneously supplying the held pixel signals corresponding data lines.

In a further aspect of the present invention, a data driving method for a liquid crystal display device comprises performing a time-division on a digital pixel data and providing the time-divided digital pixel data through output channels having a polarity, converting the time-divided digital pixel data into analog pixel signals having the polarity, sampling and holding the time-divided analog pixel signals to output channels having the polarity; and outputting the held pixel signals to corresponding data lines for a next horizontal period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 3:
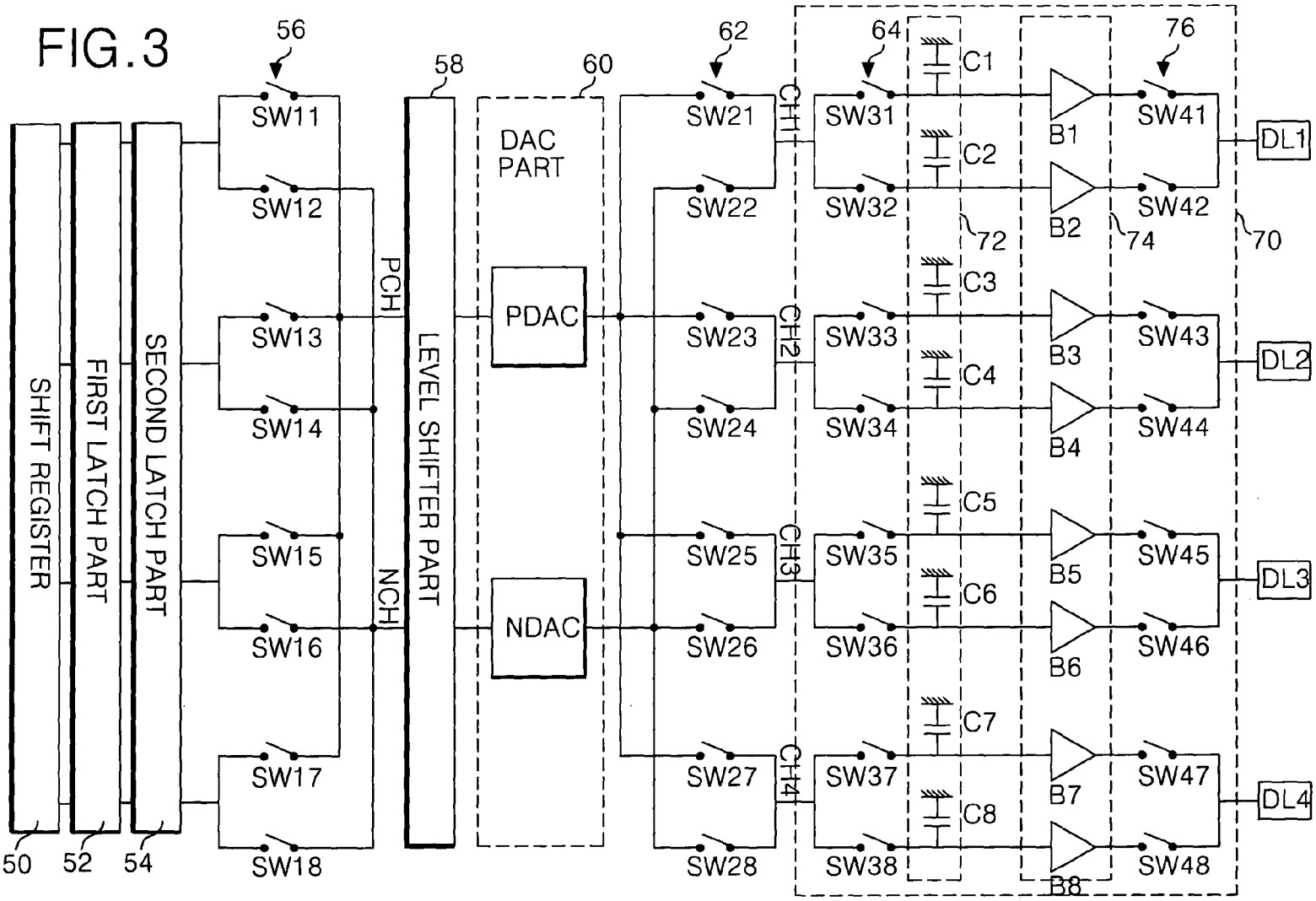
FIG. 3 is a detailed block diagram of a data driving integrated circuit according to a first embodiment of the present invention.

FIG. 3 shows a detailed diagram of a data driving integrated circuit (IC) in the liquid crystal display device according to a first embodiment of the present invention.

Although the data driving IC of the FIG. 3 drives a plurality of data lines, only four data lines DL1 to DL4 are illustrated in FIG. 3 for simplicity. To this end, the data driving IC includes first and second latch blocks 52 and 54 for latching and outputting pixel data in accordance with a sampling signal for a shift register 50, a MUX1 block 56 for perform a time-division on the pixel data from a second latch block 54, a digital analog converter (DAC) block 60 for converting the pixel data from the MUX1 block 56 into analog pixel signals, a demultiplexer (hereinafter, referring to the "DEMUX1") block 62 for determining an output channel of the pixel signal from the DAC block 60, a outputting block 68 for outputting the pixel signal from the DEMUX1 block 62 to a corresponding data line. Further, the data driving IC includes a level shifter part 58 connected between the MUX1 block 56 and the DAC block 60. The data driving IC further includes a signal controlling part (not shown) for relaying the control signals and the pixel data from an external timing control block (not shown), and a gamma voltage block (not shown) for subdividing and supplying reference gamma voltages from an external reference gamma voltage block (not shown).

A shift-register 50 sequentially shifts a source start pulse (SSP) from the signal controlling part (not shown) in accordance with a source start pulse (SSC) to generate the sampling signal.

In response to the sampling signal from the shift register 50, a first latch part 52 sequentially samples and latches the pixel data D1 to D4 from the signal controlling part, and supplies the latched pixel data D1 to D4 to a second latch part 54. The second latch part 54 latches the pixel data D1 to D4 from the first latch part 52, and then simultaneously outputs the pixel data in response to a signal output enable (SOE) signal from the signal controlling part.

Each of the first and the second latch parts 52 and 54 is comprised of latches corresponding to the number of the latched pixel data. Each latch has a 6-bit or 8-bit corresponding to the pixel data.

The MUX1 block 56 time-divides the pixel data from the second latch part 54, and supplies the time-divided pixel data to a designated outputting channel. For example, the MUX1 block 56 time-divides the pixel data D1 to D4 from the second latch part 54 by a first control signal using a polarity control (POL) signal and the ODD/EVEN signal of FIG. 4, and supplies the pixel data to first and second outputting channels PCH and NCH with a selected polarity. To this end, the MUX1 part 56 includes odd-numbered switches SW11, SW13, SW15 and SW17 of a positive path respectively connected to the outputting channels of the second latch part 54 and commonly connected to the first outputting channel PCH, and even-numbered switches SW12, SW14, SW16 and SW18 of a negative path respectively connected to the outputting channels of the second latch part 54 and commonly connected to the second outputting channel NCH. The first outputting channel PCH is connected to a positive digital analog converter (PDAC) through the level shifter part 58 to define the positive path, and the second outputting channel NCH is connected to a negative digital analog converter (NDAC) to define the negative path.

The level shifter part 58 serves to raise the voltage of the pixel data supplied through the first and second outputting channels PCH and NCH to an appropriate voltage for the DAC part 60.

The DAC part 60 includes the PDAC and the NDAC that are respectively connected to the output channels of the level shifter part 58. The PDAC converts the digital pixel data into a positive (with respect to Vcom) analog pixel signal by using positive gamma voltages from the gamma voltage part (not shown). The NDAC converts the digital pixel data into a negative (with respect to Vcom) analog pixel signal by using negative gamma voltages from the gamma voltage part.

As described above, although the DAC 60 converts the pixel data of four channels into the analog pixel signal, the DAC part 60 requires only one PDAC and one NDAC because the pixel data is time-divided and has a selected polarity by the MUX1 part 56. Therefore, the number of the PDAC and NDAC can be reduced to ¼ of the number of the related art data driving IC of FIG. 2, thereby simplifying the DAC part 60.

The DEMUX1 part 62 supplies the pixel signals with a determined polarity by the DAC part 60 through an appropriate channel selected from a plurality of the outputting channels. In other words, the DEMUX1 part 62 supplies the positive and the negative pixel signals supplied from the PDAC and NDAC to the two outputting channels of the four outputting channels CH1 to CH4, respectively during the first half of a horizontal period. In addition, the DEMUX1 part 62 supplies the positive and negative pixel signals supplied from the PDAC and NDAC to the remaining two outputting channels, respectively during the second half of the horizontal period. To this end, the DEMUX1 part 62 includes the odd-numbered switches SW21, SW23, SW25 and SW27 commonly connected to the PDAC and respectively connected to the first to the fourth outputting channels CH1 to CH4, and the even-numbered switches SW22, SW24, SW26 and SW28 of the negative channel commonly connected to the NDAC and respectively connected to the first to fourth outputting channels CH1 to CH4. Each of the even-numbered and odd-numbered switches SW21 to SW28 of the DEMUX1 part 62 is turned-on/off in accordance with its corresponding switch of the MUX1 part 56 depending on the first control signal using the POL signal and the ODD/EVEN signal shown in FIG. 4.

An outputting part 70 charges and holds the pixel signals supplied from the DEMUX1 part 62 during the first and second halves of one horizontal period, and then simultaneously outputs the pixel signals to the corresponding data lines during the next horizontal period. To this end, the outputting part 70 includes DEMUX2 part 64, a holding part 72, and an outputting buffer part 74 which function as a sampling part, and the MUX2 part 76 which functions as a discharging part.

Figure 4:
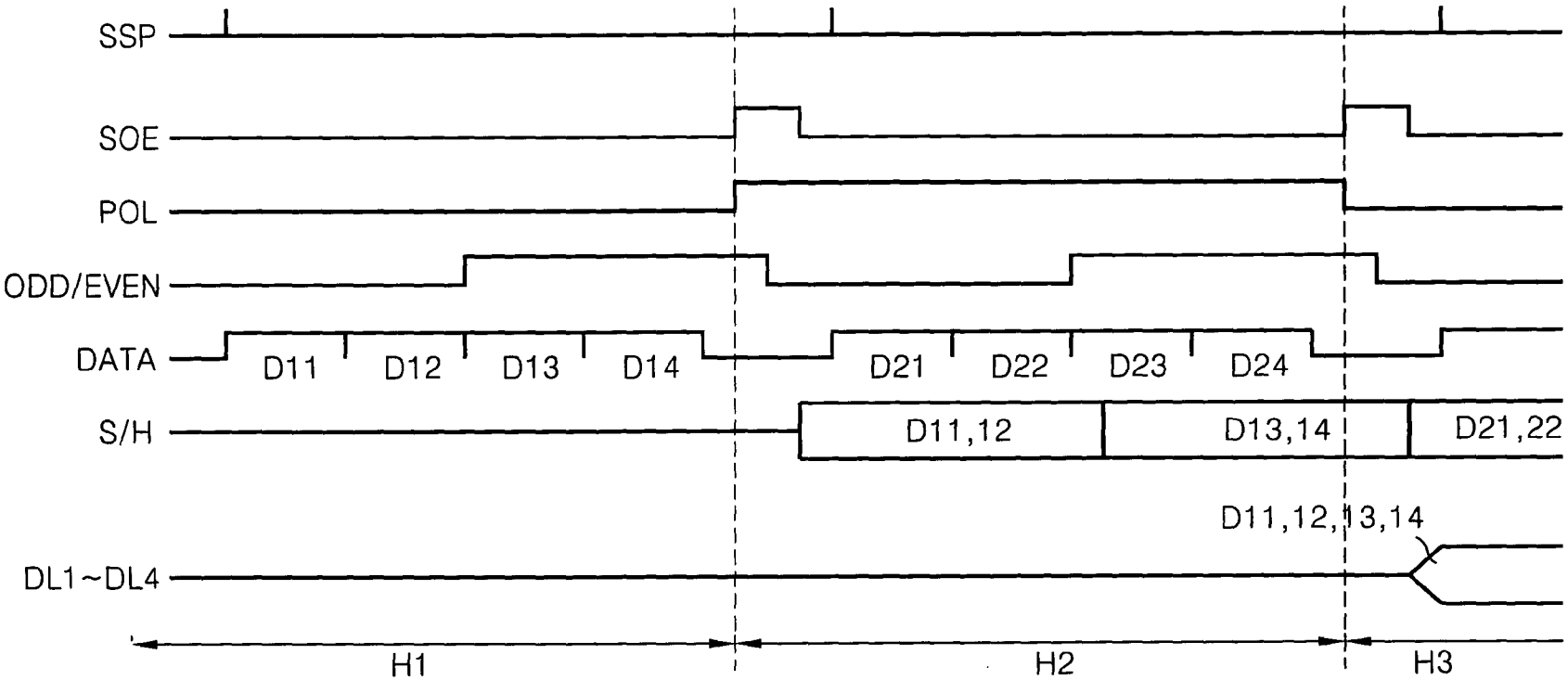
FIG. 4 is a driving wave form of the data driving integrated circuit of the FIG. 3.

The DEMUX2 part 64 includes odd-numbered switches SW31, SW33, SW35 and SW37 of the positive channel which are connected to the outputting channels CH1 to CH2 of the DEMUX1 part 62 respectively, and even-numbered switches SW32, SW34, SW36 and SW38 of the negative channel which are connected to the outputting channels CH 1 to CH2, respectively. The holding part 76 includes capacitors C1 to C8 connected in parallel to the switches SW21 to SW 28 of the DEMUX2 part 64, respectively. Each of the switches SW 21 to SW28 of the DEMUX2 part 64 is turned on/off in accordance with the corresponding switches of the MUX1 part 56 and the DEMUX1 part 62 depending on the first control signal using the POL signal and the ODD/EVEN signals shown in FIG. 4. For example, the DEMUX2 part 64 charges and holds the pixel signal D11 to D14 in the amount of the first horizontal line to the capacitors with the same polarity path to the pixel signals during one horizontal period as shown in FIG. 4. Further, the DEMUX2 part 64 charges and holds the pixel signals D21 to D24 with a reversed polarity in the amount of the second horizontal line to the capacitors with the polarity opposite to that of the previous horizontal period during the next horizontal period.

The MUX2 part 76 allows the pixel signals D1 to D4 charged in the capacitor with the polarity during the previous horizontal period to discharge through the outputting buffer with a polarity path during the present horizontal period. The discharged pixel signals are supplied to their corresponding data lines. To this end, the MUX2 part 76 includes odd-numbered switches SW41, SW43, SW45 and SW47 of the positive path connected through each of odd-numbered switches SW31, SW33, SW35 and SW37 of the DEMUX2 part 64 and each of the odd outputting buffers B1, B3, B5 and B7, and even-numbered switches SW42, SW44, SW46 and SW48 of the negative channel connected through each of even-numbered switches SW32, SW34, SW36 and SW38 of the DEMUX2 part 64 and each of even-numbered outputting buffers B2, B4, B6 and B8. Each of the even- and odd-numbered switches SW41 to SW48 of the MUX2 part 76 is turned-on/off to the polarity path opposite to that of the switches SW 31 to SW 38 of the DEMUX2 part 64 because the charged pixel signals for the previous horizontal period must be discharged for the present horizontal period. In other words, the MUX2 part 76 is controlled by the first control signal and the second control signal with a phase inversion using the POL signal and the ODD/EVEN signals shown in FIG. 4. For example, the MUX2 part 76 supplies the pixel signals D11 to D14 in the amount of the first horizontal line held in the capacitor of the corresponding polarity for the second horizontal period H2 as in FIG. 4 to the respective data lines DL1 to DL4 for the third horizontal period H3.

A MUX3 part (not shown) may be additionally provided between the MUX2 part 76 and the data lines, which controls the supplying timing of the pixel signal in response to the SOE signal. The MUX3 part supplies the pixel signals from the MUX2 part 76 to corresponding data line for an enable period of the SOE signal, and supplies the common voltage Vcom to each data line for a disable period of the SOE signal in order to drive liquid crystal cell Clc.

The driving method of the data driving IC will be explained with reference to waveforms shown in FIG. 4.

The first latch part 52 latches the pixel data D11 to D14 of the first horizontal line for the first horizontal period H1 in accordance with the sampling signal from the shift register 50.

Next, for the second horizontal period H2, the first latch part 52 outputs the latched pixel data D11 to D14 to the second latch part 54, and then latches the pixel data D21 to D24 of the second horizontal line as set forth above. At this time, the second latch part 54 outputs the pixel data D11 to D14 of the first latch part 54 for the enable period of the MSOE period as shown in FIG. 4. The pixel data D11 to D14 outputted from the second latch part 54 are converted into the analog signal by the DAC part 60 within the enable period of the MSOE signal and then is charged and held in its corresponding capacitor in the outputting part 270.

More specifically, the pixel data D11 to D14 are time-divided through the MUX1 part 56, DEMUX1 part 62, and the DEMUX2 part 64 in response to the POL signal and the ODD/EVEN signal as shown in FIG. 4, and are charged to the capacitor through the path with the determined polarity.

The D11 to D14 of the first horizontal line are supplied through the second latch part 54 for the first half of the second horizontal period H2. Among the D11 to D14, the D11 is selected by the switch SW11 in the MUX1 part 56, and then is charged and held to the capacitor C1 through the stream of the level shifter part 58, PDAC, the SW21 of the DEMUX1 part 62 and the switch SW31 of the DEMUX2 part 64. The D12 is selected by the SW14 of the MUX1 part 56, and charged for holding to the capacitor C4 through the stream of the level shifter part 58, NDAC, the switch SW24 of the DEMUX1 part 62, and the switch SW34 of the DEMUX2 part 64. In addition, the D13 is selected by the switch SW15 of the MUX1 part 56 for the later half of the second horizontal period H2 and then is charged for holding to the capacitor C5 through the stream of the level shifter part 58, PDAC, the switch SW25 of the DEMUX1 part 62 and the SW35 of the DEMUX2 part 64. And, the D14 is selected by the SW18 of the MUX1 part 56 and charged for holding to the capacitor C8 through the stream of the level shifter part 58, the NDAC, the switch SW28 of the DEMUX1 part 62 and the switch SW38 of the DEMUX2 part 64.

Next, the pixel data D1 to D4 held in the C1, C4, C5 and C8 through the SW41, SW44, SW45 and SW48 of the MUX2 part 76 for the second horizontal period H2 are supplied to the respective corresponding data lines DL1 to DL4 for the third horizontal period H3.

In the meantime, for the first half of the third horizontal period H3, among the D21 to D24 supplied from the second latch part 54, the D21 is selected by the SW21 of the MUX1 part 56 and the D21 is charged and held to the C2 through the stream of the level shifter part 58, the NDAC, the switch SW22 of the DEMUX1 part 62 and the SW32 of the DEMUX2 part 64. On the other hand, the D22 is selected by the SW13 of the MUX1 part 56 and then is charged and held to the C3 through the stream of the level shifter part 58, the PDAC, the SW23 of the DEMUX1 part 62 and the SW33 of the DEMUX2 part 64. And, for the later half of the third horizontal period, the D23 is selected by the SW16 of the MUX1 part 56 and charged and held in the C6 through the stream of the level shifter part 58, the NDAC, the SW27 of the DEMUX1 part 62 and the SW37 of the DEMUX2 part 64. The D24 is selected by the SW17 of the MUX1 part 56, and charged and held in the C7 through the stream of the level shifter part 58, the PDAC, the SW27 of the DEMUX1 part 62 and the SW37 of the DEMUX2 part 64. These D21 to D24 held in the capacitors C2, C3, C6 and C7 are supplied to their corresponding data lines DL1 to DL4 for a next horizontal period, respectively.

As described above, the data driving IC according to the present invention performs a time-division and converts the pixel data to the analog signal and determines a polarity path of the pixel data performing the time-division. Accordingly, the number of the PDAC and the NDAC can be reduced to ¼ of that of the related art data driving IC shown in FIG. 3, and the number of the driving data lines are increased twice. As a result, the number of the data driving IC required in the liquid crystal display device can be reduced to one half in the data driving drive IC of the present invention.

In this case, within the data driving IC, the odd-numbered output buffers included in the positive channel per data line are connected in parallel to the even-numbered output buffers included in the negative channel. However, when the two output buffers are connected to one data line, if the two output buffers have a particular deviation, the display quality can be deteriorated by the output deviation between the pixel signals. Such an output deviation of the pixel signals can be overcome by using one output buffer for each data line in the present invention.

Figure 5:
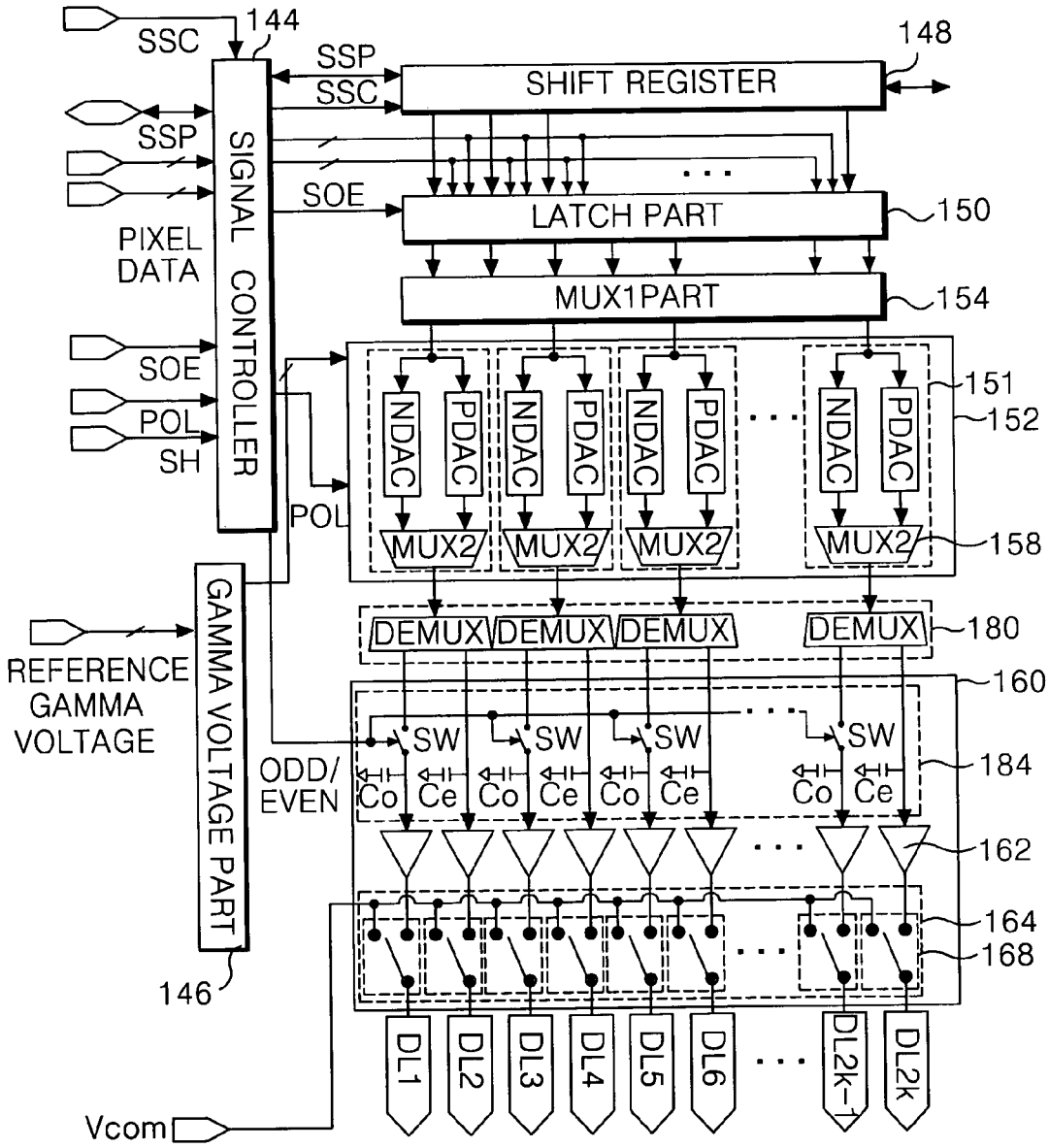
FIG. 5 is a detailed block diagram of a data driving integrated circuit according to a second embodiment of the present invention.

FIG. 5 is a detailed diagram of a data driving IC according to a second embodiment of the present invention.

For simplicity, it is assumed that the data driving IC shown in the FIG. 3 drives 2*k*-number of the data lines DL1 to DL2*k*. To this end, the data driving IC includes a latch part 150 for latching pixel data in accordance with a sampling signal from a shift register 148, a MUX1 part 154 for performing a time-division on the pixel data from the latch part 150, a DAC part 152 for converting the pixel data from the MUX1 part 154 into the analog signal, a DEMUX part 180 for determining the output channel of the pixel signal from the DAC part 152, and an outputting part 160 for sampling and holding the pixel signal from the DEMUX part 180.

The data driving IC further includes a signal controlling part 144 for controlling control signals from an external timing controlling part (not shown) and the pixel data, and a gamma voltage part 146 for subdividing a plurality of reference gamma voltages from an external reference gamma voltage part (not shown).

The signal controlling part 144 relays a variety of control signals SSP, SSC, SOE and POL and the pixel data from the timing controlling part (not shown) to the corresponding components.

The gamma voltage part 146 subdivides the reference gamma voltages inputted from the reference gamma voltage part (not shown) by gray level, to provide the subdivided reference gamma voltages to the DAC part 152. In this case, the gamma voltage part 146 supplies a set of positive gamma voltages and a set of negative gamma voltages with respect to the common voltage, which is the reference signal in driving the liquid crystal cell.

The shift register 148 sequentially shifts the SSP inputted from the signal controlling part 144 in accordance with the SSC to generate the sampling signal.

The latch part 150 sequentially samples and latches the pixel data from the signal controlling part 144 in response to the sampling signal from the shift register 148. The latch part 150 is composed of the 2*k*-number of the latches for latching 2*k*-number of the pixel data. Each of the latches has the size corresponding to the bit number (e.g., 3-bit or 6-bit of the pixel data). The latch part 150 simultaneously outputs the latched 2*k*-number of the pixel data in response to the SOE signal from the signal controlling part 144. Such the latch part 150 includes a first latch part (not shown) for sampling and latching the pixel data, and a second latch part (not shown) for simultaneously supplying the pixel data in the first latch in response to the SOE signal.

The MUX1 part 154 performs a time-division on the pixel data from the latch part 150, which will be provided to the DAC part 160. In response to the ODD/EVEN signal shown in FIG. 6, the MUX1 part 154 performs a time-division on the 2*k*-number of the pixel data from the latch part 150 to the k-number of the pixel data, that is, the odd-numbered pixel data and the even-numbered pixel data provided to the DAC part 152.

The DAC part 152 converts the k-number of the pixel data that is time-divided in the MUX1 part 154 into the analog pixel signal having a selected polarity in accordance with the POL signal. To this end, the DAC part 152 includes the k-number of the DACs 151. Each of the DACs 151 includes a PDAC, a NDAC, and a second MUX 158 for selecting one of the output signals from the PDAC and the NDAC. Such a DAC part 152 converts the k-number of the even-numbered (or odd-numbered) pixel data that is inputted earlier, into the analog odd-numbered pixel signal, and converts the k-number of the odd-numbered (or even-numbered) pixel data that is inputted later, into the analog even-numbered pixel signals.

The PDAC converts the digital pixel data from the MUX1 part 154 into the positive (with respect to Vcom) analog pixel signal using the positive gamma voltages from the gamma voltage part 146.

The NDAC converts the digital pixel data from the MUX1 part 154 into the negative (with respect to Vcom) analog pixel signal using the negative gamma voltages from the gamma voltage part 146.

The MUX2 part 158 selects one of the positive pixel signal from the PDAC and the negative pixel signal from the NDAC in response to the POL signal from the signal controlling part 144.

The DEMUX part 180 provides the k-number of output path by selecting the 2*k*-number of output channel. To this end, the DEMUX part 180 includes the k-number of the DEMUXs for selecting one of the ODD/EVEN output channels for the k-number of the pixel signals from the DAC part 152. For example, if the k-number of the even-numbered (or odd-numbered) pixel signals is inputted from the DAC part 152, each of the DEMUXs selects the even-numbered output channels for supplying the even-numbered pixel signals. On the other hand, if the odd-numbered (or even-numbered) pixel signals are inputted from the DAC part 152, each of the DEMUXs selects the odd output channels for supplying the odd-numbered pixel signals.

The output buffering part 160 samples and holds the k-number of the pixel signals inputted earlier from the DEMUX part 180 and then holds the remaining k-number of the later inputted pixel signals. And, the output buffering part 160 supplies the 2*k*-number of the pixel signals held in the data lines DL1 to DL2*k*, respectively. To this end, the output buffering part 160 includes a sampling/holding part 184 for sampling and holding the pixel signals from the DEMUX part 180, an output buffers 162 for buffering the pixel signals from the sampling/holding part 184, and a MUX3 part 164 for outputting the pixel signals from the output buffers 162 in response to the SOE signal.

Figure 6:
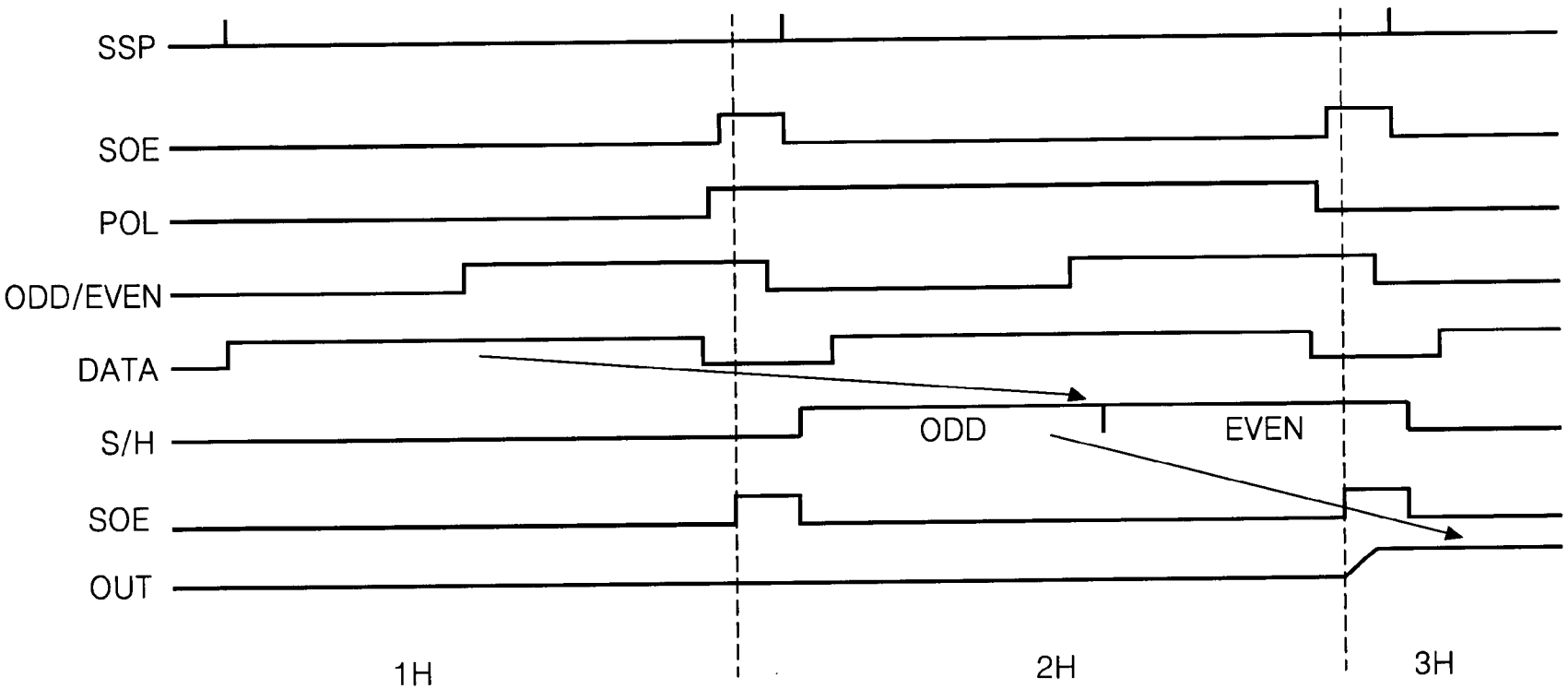
FIG. 6 is a driving wave form of the data driving integrated circuit of FIG. 5.

The sampling/holding part 184 includes even-numbered capacitors connected to the odd-numbered channels, odd-numbered capacitors connected to the even-numbered channels, and a switching device SW connected to the previous stage of the odd-numbered (or even-numbered) capacitors. The switching devices SW are turned-on only for the odd-numbered sampling periods within the ODD/EVEN signal from the signal controlling part 44 as shown in FIG. 6 is in a certain state, such as a low-level state. The switching devices SW turned-on for the odd-numbered sampling period samples the odd-numbered pixel signals inputted through the odd-numbered channels from the DEMUX part 180 as shown in FIG. 4, which are then held in the odd-numbered capacitors. The switching devices SW are turned-off for the period contrary to the odd-numbered sampling periods, for example, for the period of the ODD/EVEN signal in a high-level state. At this time, the even-numbered capacitors hold the even-numbered pixel signals inputted through the even-numbered channels from the DEMUX part 80.

Each of the odd-numbered and even-numbered pixel signals held in each of the odd-numbered capacitors and the even-numbered capacitors of the sampling/holding part 84 are supplied to the MUX4 part 164 through the corresponding output buffer 162.

The MUX3 part 164 supplies the odd and the even pixel signals inputted through each of the output buffers 162 to each of the corresponding data lines DL1 to DL2*k* for the enable period of the SOE signal from the signal controlling part 144, or the MUX3 part 164 commonly supplies the common voltage to the data lines DL1 to DL2*k* for the disable period of the SOE signal. To this end, the MUX3 part 164 responses to the SOE signal and includes a MUX3 part 68 respectively connected between the output buffers 162 and the corresponding data lines.

Figure 1:
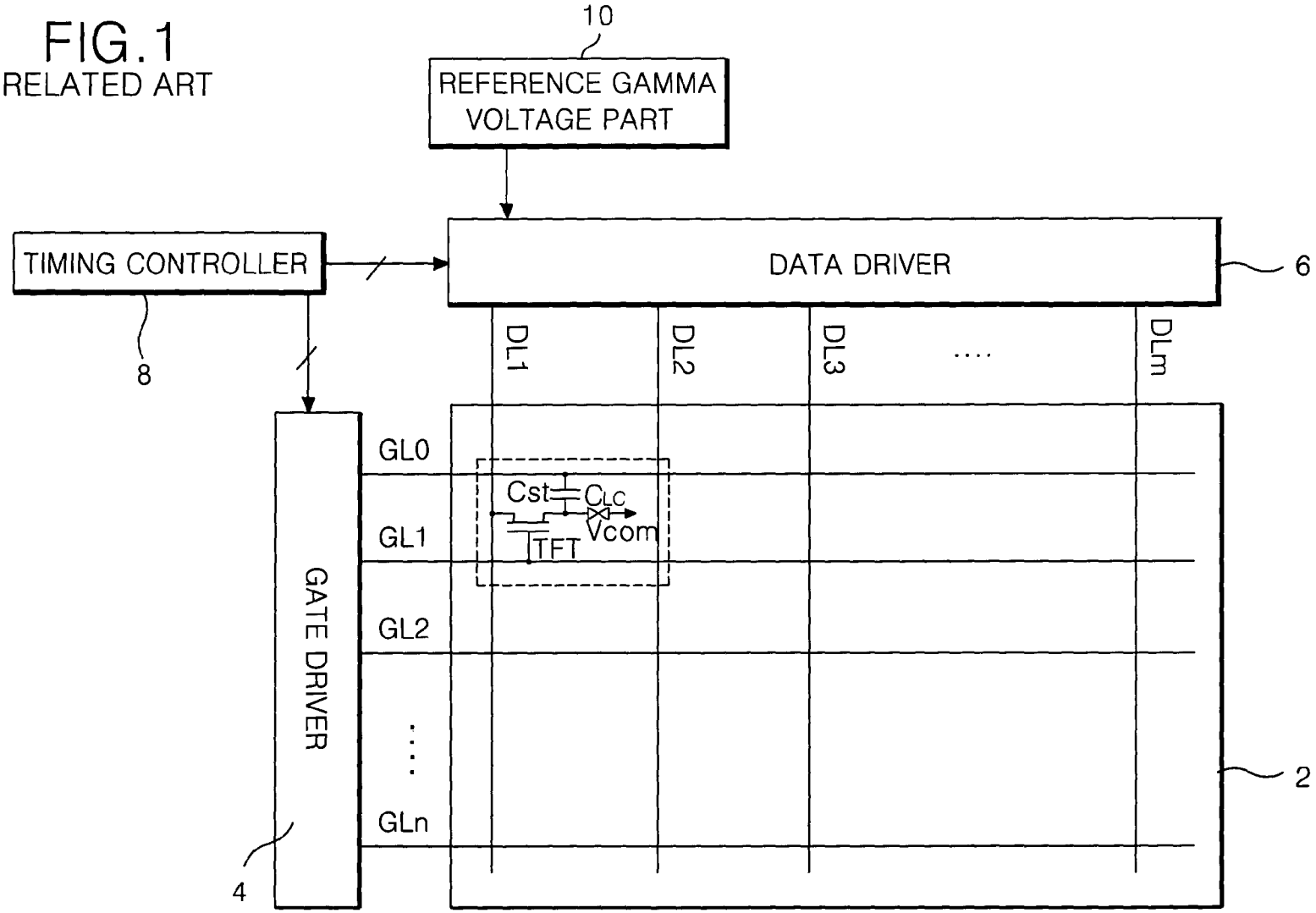
FIG. 1 RELATED ART
FIG. 1 is a schematic block diagram showing a related art liquid crystal display module.
Figure 2:
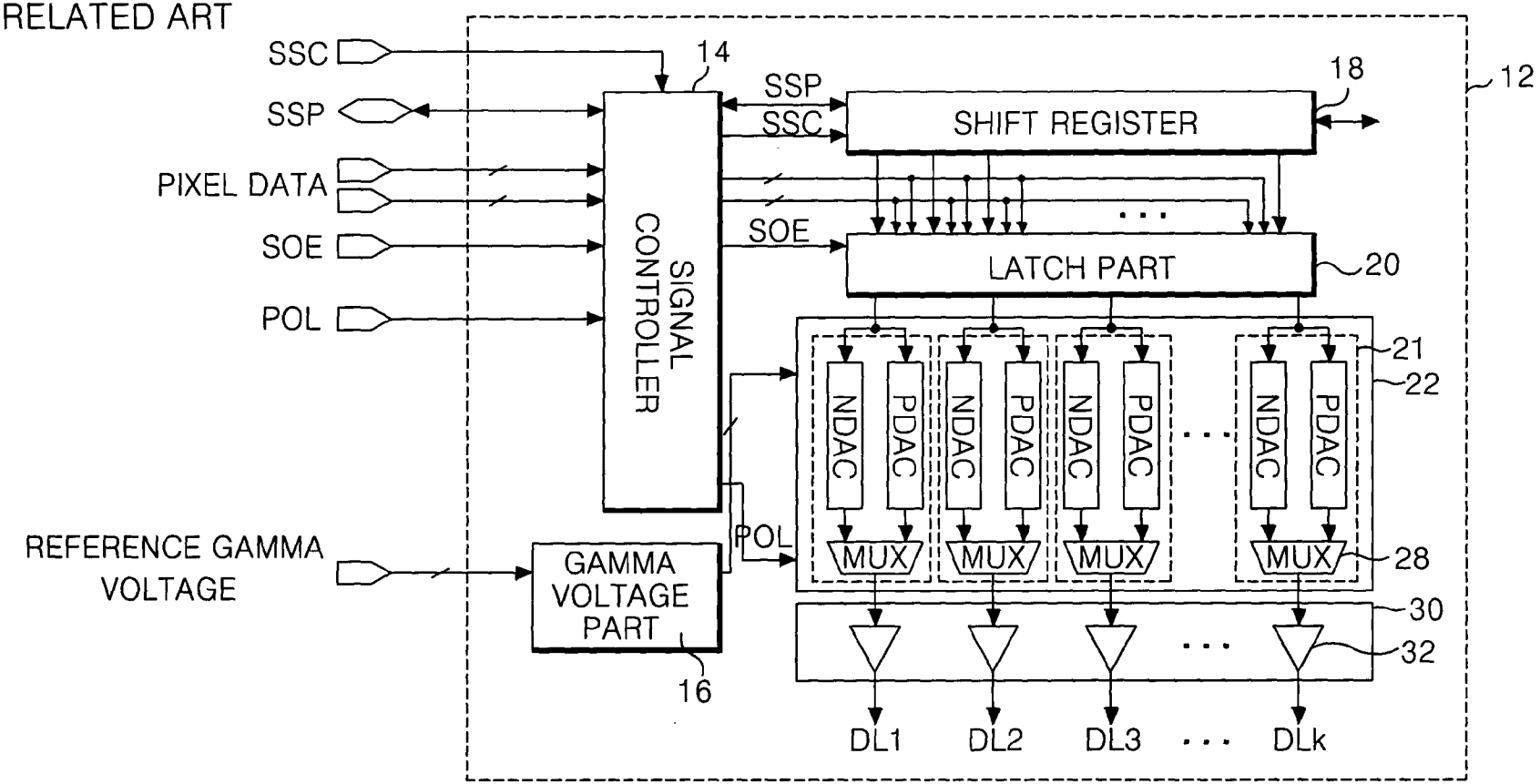
FIG.2 RELATED ART
FIG. 2 is a detailed block diagram of a data driving integrated circuit incorporated in the data driver of FIG. 1.

As set forth above, the data driving IC according to the second embodiment of the present invention performs a time-division on the pixel data, thereby reducing the number of the DACs 151 including the PDAC, the NDAC, and the MUX2 to one half of that of the related art data driving IC of FIG. 2. In addition, the number of the driving data lines is increased twice. As a result, the number of the data driving ICs required for the LCD panel is reduced to one half when the data driving IC of the present invention is employed. Further, the data driving IC according to the second embodiment of the present invention prevents deterioration in the display quality caused by the deviation induced between the output buffers by using one output buffer for each data line.

Figure 7:
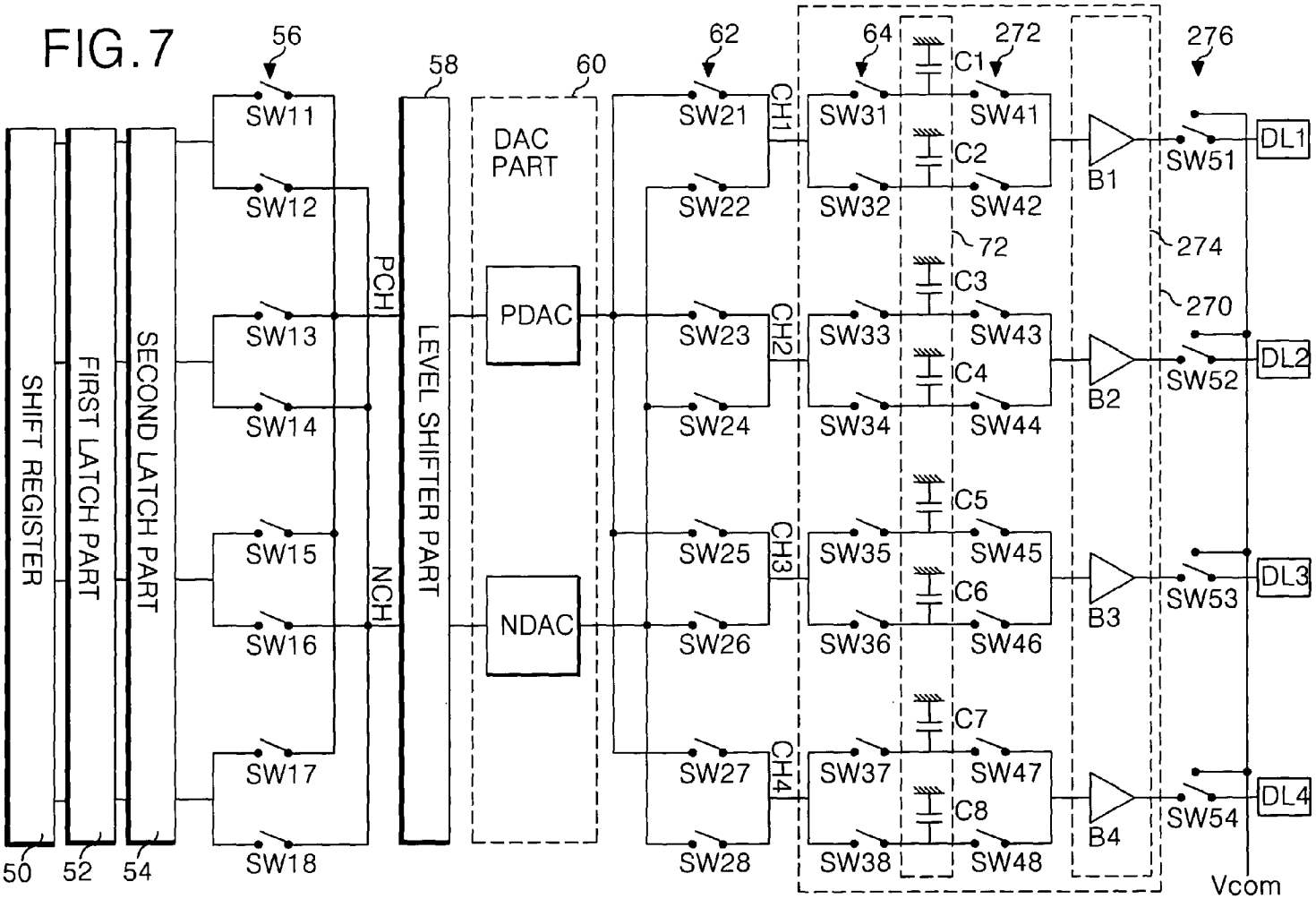
FIG. 7 is a detailed block diagram of a data driving integrated circuit according to a third embodiment of the present invention.

FIG. 7 shows a detailed diagram of a data driving IC of the LCD according to a third embodiment of the present invention.

The data driving IC shown in FIG. 7 includes similar components to the data driving IC shown in FIG. 3 except for that the output buffering part 274 in the outputting part 270 is connected to the output channel of the MUX2 part 272 and an additional MUX3 part 276 is added. Therefore, the detailed description for the similar components will be omitted for simplicity.

The MUX2 part 272 as a portion of the discharging part in FIG. 7 is connected between the holding part 72 and the output buffer part 274. The MUX2 part 272 allows the pixel signals charged to the capacitor with a polarity for the previous horizontal period to be supplied to the output buffer part 274 for the present horizontal period. To this end, the MUX2 part 272 includes odd-numbered switches SW41, SW43, SW45 and SW47 with a positive path respectively connected between the odd-numbered switches SW31, SW33, SW35 and SW37 of the DEMUX2 part 64 and the output buffers B1 to B4, and even-numbered switches SW42, SW44, SW46 and SW48 with a negative path respectively connected between the even-numbered switches SW32, SW34, SW36 and SW38 of the DEMUX2 part 64 and the output buffers B1 to B4. The switches SW41 to SW 48 of the MUX2 part 272 are turned on/off with the polarity path opposite to that of the switches SW 31 to SW38 of the DEMUX2 part 64 because the pixel signals charged for the previous horizontal period must be discharged for the present horizontal period. More specifically, the MUX2 part 272 is controlled by the first control signal and the second control signal with a phase inversion by using the POL signal and the ODD/EVEN signal as shown in FIG. 4.

Figure 8:
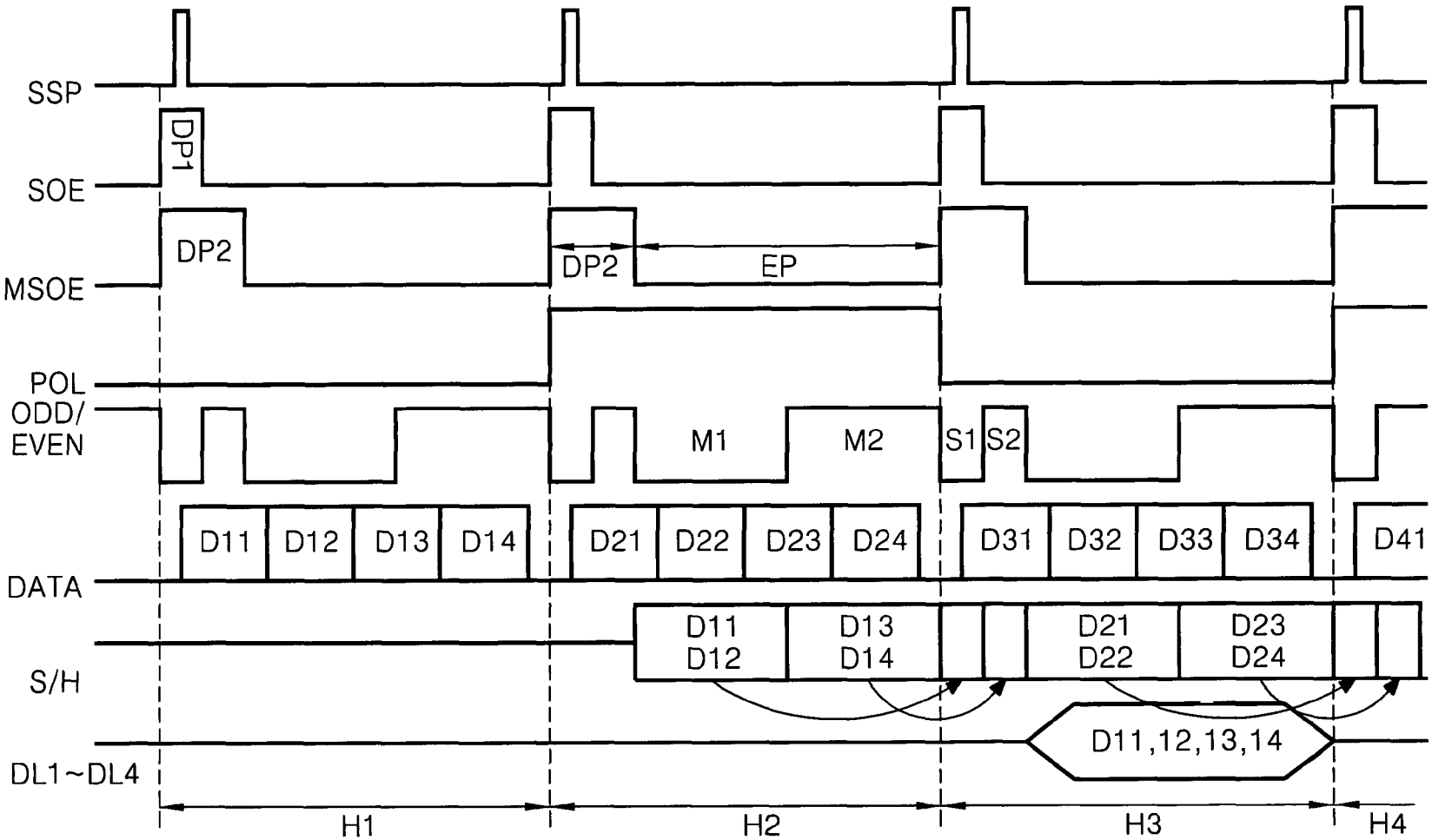
FIG. 8 is a driving waveform of the data driving integrated circuit of FIG. 7.

The MUX3 part 276 is connected between the output buffer part 274 and the data lines and controls the supplying timing of the pixel signals in response to the MSOE signal shown in FIG. 8. More specifically, the MUX3 part 276 supplies the pixel signals from the output buffer part 274 to the data lines DL1 to DL4 for the enable period of the MSOE signal shown in FIG. 8 and supplies the common voltage to each of the data lines DL1 to DL4 for the disable period.

A driving method for the data driving IC will be explained with reference to waveform shown in the FIG. 8.

The first latch part 52 latches pixel data (hereinafter, referred to as "D11 to D14") of the first horizontal line in accordance with the sampling signal from the shift register 50 for the first horizontal period.

During the second horizontal period, the first latch part 52 outputs the latched D11 to D14 to the second latch part 54, and sequentially latches the pixel data of the second horizontal line (hereinafter, referred to as "D21 to D24"). At this time, the second latch part 54 outputs the D11 to D14 latched in the first latch part 52 for the enable period of the MSOE as shown in FIG. 8. The D11 to D14 outputted from the second latch part 54 are converted into the analog signal through the DAC part 60 within the enable period EP of the MSOE signal and charged and held to the respective corresponding capacitors in the output part 270. In this case, the D11 to D14 are time-divided by the MUX1 part 56, the DEMUX1 part 62, the DEMUX2 part 64 in accordance with the first control signal using the POL and ODD/EVEN signals shown in FIG. 8 and are charged to the respective corresponding capacitors through the cannel with the determined polarity.

More specifically, the enable period EP of the second horizontal period is time-divided into the first and second main periods M1 and M2 in accordance with the ODD/EVEN signal. And, a following disable period DP of the third horizontal period is time-divided into the first and second sub-periods S1 and S2 for recharging. To this end, the polarity of the ODD/EVEN signal is alternately reversed between the first and second main periods M1 and M2 and the first and second sub-periods S1 and S2. In this connection, the disable period DP2 of the MSOE signal is settled longer than the disable period DP1 of the standard SOE signal as shown in FIG. 8 in order to preserve the first and second sub-periods S1 and s2. Such MSOE signal is produced by counting the SSC from the rising edge of the standard SOE signal in the timing controlling part (not shown) or in the signal controlling part (not shown) of the data driving IC.

During the first main period M1 of the second horizontal period H2, the D11 is selected by the SW11 of the MUX1 part 56 in accordance with the first controlling signal using the POL signal and the ODD/EVEN signal, and is then charged and held to the C1 through the stream of the level shifter part 58, the PDAC, the SW21 of the DEMUX1 part 62 and the SW31 of the DEMUX part 64. On the other hand, the D12 is selected by the SW14 of the MUX1 part 56 and is then charged and held to the C4 through the stream of the level shifter part 58, the NDAC, the SW24 of the DEMUX1 part 62 and the SW34 of the DEMUX2 part 64.

During the second main period M2, in accordance with the first controlling signal using the POL signal and ODD/EVEN signal, the D13 is selected by the SW15 of the MUX1 part 56 and is then charged and held to C5 through the stream of the level shifter part 58, the PDAC, the SW25 of the DEMUX1 part 62 and the SW 35 of the DEMUX2 part 64. And, the D14 is selected by the SW18 of the MUX1 part 56 and is then charged and held to the C8 through the stream of the level shifter part 58, the NDAC, the SW28 of the DEMUX1 part 62 and the SW 38 of the DEMUX2 part 64.

During the first sub-period S1 of the third horizontal period H2, the D1 and the D12 are recharged to the C1 and C4 through the same channel as for the first main period M1 in accordance with the first control signal using the POL signal and the ODD/EVEN signal. During the second sub-period S3, the D13 and D14 are recharged to the C5 and the C8 through the same channel as for the second main period M2 in accordance with the first control signal using the POL signal and the ODD/EVEN signal. Accordingly, during the disable period of the third horizontal period, a leakage of the pixel signals charged to the respective C1, C4, C5 and C8 for the second horizontal period can be compensated.

Subsequently, during the enable period EP of the third horizontal period, the pixel signals held to the corresponding capacitors for the second horizontal period are supplied to the corresponding data lines through the stream of the MUX2 part 272, the output buffer part 274 and MUX3 part 276.

More specifically, for the enable period EP of the third horizontal period, the D11 to D14 held to the C1, C4, C5 and C8 for the second horizontal period are discharged through the SW41, SW44, SW45 and SW48 of the MUX2 part 272. The discharged D11 to D14 are simultaneously supplied to the data lines DL1 to DL4 through the output buffers D1 to D4 and the SW51, SW52, SW53 and SW54 of the MUX3 part 276. And then, for the following disable period DP of the fourth horizontal period, the common voltage is commonly supplied to the data lines DL1 to DL4 through the MUX3 part 276.

On the other hand, among the D21 to D24 which are supplied through the second latch part 54 for the first main period of the third horizontal period, the D21 is selected by the SW13 of the MUX1 part 56 and is then charged and held to the C2 through the stream of the level shifter part 58, the NDAC, the SW22 of the DEMUX1 part 62 and the SW32 of the DEMUX2 part 64. The D22 is selected by the SW13 of the MUX1 part 56 and is then charged and held to the C3 through the stream of the level shifter part 58, the PDAC, the SW23 of the DEMUX1 part 62 and the SW33 of the DEMUX2 part 64. During the second main period M2, the D23 is selected by the SW16 of the MUX1 part 56 and is then charged and held to the C6 through the stream of the level shifter part 58, the NDAC, the SW26 of the DEMUX1 part 62 and the SW 36 of the DEMUX2 part 64. The D24 is selected through the SW17 of the MUX1 part 56 and is then charged and held to the C7 through the stream of the level shifter part 58, the PDAC, the SW27 of the DEMUX1 part 62 and the SW37 of the DEMUX2 part 64. For the following first and second sub-periods S1 and S2, the D21, D22, D23 and D24 are recharged to the C2, C3, C6 and C7 through the path as described above.

The D21 to D24 held to the C2, C3, C6 and C7 are supplied to the data lines DL1 to DL4 through the stream of the MUX2 part 272, the output buffer part 274, and the MUX3 part 276 for the next horizontal period.

As set forth above, the data driving IC according to the third embodiment of the present invention performs a time-division on the pixel data, converts the time-divided pixel signal into the analog signals, and determines the polarity channel of the pixel data, thereby decreasing the number of the PDAC and NDAC to ¼ of that of the related art data driving IC as shown in FIG. 3 and increasing the number of the driving data lines to twice. As a result, the number of the data driving ICs required in the LCD panel can be reduced to one half. Further, the data driving IC according to the third embodiment of the present invention prevents a deterioration of the picture quality caused by a deviation induced between the output buffers by using one output buffer for each data line.

As described above, according to the data driving apparatus and method for the LCD of the present invention, the number of the PDAC and the NDAC can be reduced to one fourth of that of the related art PDAC and NDAC and the number of the driving data lines can be increased twice by performing a time-division on the pixel data and converting the time-divided pixel data into the analog signals as well as determining the polarity path of the pixel data while performing the time-division on the pixel data.

In addition, according to the driving data apparatus and method for the LCD device of the present invention, the number of the driving data lines is increased twice. Also, the number of the DACs including the PDAC, the NDAC and MUX2 can be reduced to one half by performing a time-division on the pixel date.

Furthermore, the number of the data driving ICs can be reduced and the deterioration of the display quality caused by the deviation between the output buffers by using an output buffer for each data line can be prevented in the present invention.

It will be apparent to those skilled in the art that various modifications and variations can be made in the data driving method and apparatus for the liquid crystal display device of the present invention without departing from the spirit or scope of the inventions. Thus, it is intended that the present invention covers the modifications and variations of this invention provided they come within the scope of the appended claims and their equivalents.

What is claimed is:

1. A data driving apparatus for a liquid crystal display device, comprising:

a shift register part sequentially shifting an input source start pulse in accordance with an input source shift clock to generate a sampling signal;

a latch part sequentially latching a plurality of digital pixel data in response to the sampling signal from the shift register part;

a multiplexer part performing a time-division on the digital pixel data for a plurality of data lines for a first horizontal period using a polarity control signal and an even/odd signal, the digital pixel data sequentially being outputted to positive and negative paths by unit of adjacent digital pixel data;

a level shifter part raising a voltage of the time-divided pixel data directly supplied from the positive and negative paths of the multiplexer part;

a digital-analog converter part including:

a positive digital-analog converter converting one digital pixel data of the adjacent digital pixel data inputted to the positive path from the level shifter part into a positive pixel signal with respect to a common voltage Vcom; and a negative digital-analog converter converting the other digital pixel data of the adjacent digital pixel data inputted to the negative path from the level shifter part into a negative pixel signal with respect to the common voltage Vcom;

a demultiplexer part providing the positive pixel signal from the positive digital-analog converter and the negative pixel signal received from the digital-analog converter to output channels of the demultiplexer part corresponding to the data lines, during the first half of the first horizontal period and during the second half of the first horizontal period; and an output part including:

a sampling part sampling the positive pixel signals and the negative pixel signals from the demultiplexer part;

a holding part holding the sampled pixel signals provided through the sampling part during the previous horizontal period of the first horizontal period; and a discharging part including:

a second multiplexer part having:

a plurality of positive path switches connected to the positive path switches of a second demultiplexer part through the holding part and connected to the data lines;

a plurality of the negative path switches connected to the negative switches of the second demultiplexer part through the holding part and connected to the data lines; and a third multiplexer part supplying the pixel signals from the output part to the corresponding data lines for the enable period of the source output enable signal and commonly supplying the common voltage Vcom of the liquid crystal cells to the corresponding data lines for the disable period of the source output enable signal, wherein the discharging part is connected between an output buffer part and the data lines and simultaneously outputs the pixel signals held in the holding part for the first horizontal period to corresponding data lines for an enable period of a source output enable signal and outputs the common voltage Vcom to the corresponding data lines for a disable period of the source output enable signal, wherein the common voltage Vcom is supplied to the corresponding data lines by the third multiplexer part, and wherein the sampling part and the holding part sample and hold the pixel signals supplied for the next horizontal period through the channel different from that of the pixel signal supplied for the first horizontal period.

2. The apparatus according to claim 1, wherein the multiplexer part comprises:

a plurality of positive path switches coupled to input channels for the pixel data and commonly connected to the positive polarity output channel; and a plurality of negative path switches coupled to the input channels for the pixel data, connected to the positive path switches in parallel, and commonly connected to negative polarity output channel.

3. The apparatus according to claim 1, wherein the demultiplexer part comprises:

a plurality of positive path switches forming a plurality of different positive paths corresponding to the data lines, and commonly connected to a positive digital-analog converter; and a plurality of negative path switches forming a plurality of different negative paths, commonly connected to a negative digital-analog converter, wherein the negative path switches are connected to the positive path switches in parallel.

4. The apparatus according to claim 1, wherein the sampling part includes the second demultiplexer part comprising:

a plurality of the positive path switches forming a plurality of different positive paths and connected to the output channels of the demultiplexer part; and a plurality of negative path switches forming a plurality of different negative paths and connected to the output channels of the demultiplexer part.

5. The apparatus according to claim 4, wherein the holding part comprises:

positive path capacitors charging and holding the positive pixel signals from the positive path switches of the second demultiplexer part; and negative path capacitors charging and holding the negative pixel signals from the negative path switches of the second demultiplexer part.

6. The apparatus according to claim 1, wherein the multiplexer part, the demultiplexer part, and the second demultiplexer part are controlled by a first control signal through an input polarity control signal and an ODD/EVEN signal performing the time-division on the first horizontal period.

7. The apparatus according to claim 6, wherein the ODD/EVEN signal performs the time-division on an enable period determined by a source output enable signal for the first horizontal period.

8. The apparatus according to claim 6, wherein the ODD/EVEN signal further performs the time-division on a disable period of the source output enable signal.

9. The apparatus according to claim 8, wherein the multiplexer part, the demultiplexer part, and the second demultiplexer part recharge the holding part with the pixel signals for the disable period, wherein the pixel signals are generated for a previous enable period.

10. The apparatus according to claim 9, wherein the source output enable signal is generated by increasing the disable period of an external reference source output enable signal in order to secure a recharging period of the holding part.

11. The apparatus according to claim 6, the second multiplexer part is controlled by a second control signal that is phase-inversed with respect to the first control signal.

12. The apparatus according to claim 6, wherein the output buffer part buffers the pixel signals discharged from the holding part to the discharging part.

13. The apparatus according to claim 12, wherein the output buffer part comprises:

a plurality of positive path output buffers connected between the positive path capacitors of the holding part and the positive path switches of the second multiplexer part; and a plurality of negative path output buffers connected between the negative path capacitors of the holding part and the negative path switches of the second multiplexer part.

14. The apparatus according to claim 1, wherein the output buffer part buffers the pixel signal supplied through the output channels of the second multiplexer part and supplying the pixel signals to each of the data lines.

15. The apparatus according to claim 14, the output buffer part comprises:

a plurality of output buffers connected between the output channels of the second multiplexer part and the data lines.

* * * * *